US010015581B2

(12) United States Patent
Cheng et al.

(10) Patent No.: US 10,015,581 B2
(45) Date of Patent: Jul. 3, 2018

(54) FEEDBACK MICROPHONE ADAPTOR FOR NOISE CANCELING HEADPHONE

(71) Applicant: Bose Corporation, Framingham, MA (US)

(72) Inventors: Lei Cheng, Wellesley, MA (US); Andrew D. Munro, Arlington, MA (US); Benjamin G. K. Peterson, West Boylston, MA (US); Ellen I. Searl, Charlton, MA (US)

(73) Assignee: BOSE CORPORATION, Framingham, MA (US)

( * ) Notice: Subject to any disclaimer, the term of this patent is extended or adjusted under 35 U.S.C. 154(b) by 30 days.

(21) Appl. No.: 15/182,039

(22) Filed: Jun. 14, 2016

(65) Prior Publication Data

US 2017/0358291 A1 Dec. 14, 2017

(51) Int. Cl.

| | |
|---|---|
| ***H04R 1/10*** | (2006.01) |
| ***H04R 19/04*** | (2006.01) |
| ***G10K 11/178*** | (2006.01) |

(52) U.S. Cl.

CPC ..... *H04R 1/1075* (2013.01); *G10K 11/178* (2013.01); *H04R 1/1083* (2013.01); *H04R 19/04* (2013.01); *G10K 2210/1081* (2013.01); *H04R 1/1016* (2013.01); *H04R 2201/003* (2013.01); *H04R 2460/01* (2013.01)

(58) Field of Classification Search

CPC .. H04R 1/1075; H04R 2460/01; H04R 19/04; H04R 2201/003; G10K 11/1788; G10K 2210/1081

See application file for complete search history.

(56) References Cited

U.S. PATENT DOCUMENTS

| | | | | |
|---|---|---|---|---|
| 4,985,925 | A | 1/1991 | Langberg et al. | |
| 6,567,525 | B1 | 5/2003 | Sapiejewski | |
| 6,597,525 | B2 | 5/2003 | Sapiejewski | |
| 6,597,792 | B1 | 7/2003 | Sapiejewski et al. | |
| 6,683,965 | B1 * | 1/2004 | Sapiejewski | H04R 1/1083 381/370 |
| 6,831,984 | B2 | 12/2004 | Sapiejewski | |
| 7,162,039 | B1 * | 1/2007 | Callahan | A61B 7/02 381/374 |

(Continued)

FOREIGN PATENT DOCUMENTS

| | | | |
|---|---|---|---|
| CN | 104394490 | A1 | 3/2015 |
| EP | 0582404 | A2 | 2/1994 |

(Continued)

OTHER PUBLICATIONS

International Search Report & Written Opinion in International Patent Application No. PCT/US17/35177, dated Jul. 13, 2017; 15 pages.

*Primary Examiner* — Regina N Holder
(74) *Attorney, Agent, or Firm* — Schmeiser, Olsen & Watts LLP

(57) ABSTRACT

A microphone adaptor comprises a body having a first end, a second end, and an opening extending from the first end to the second end. The second end is in communication with an electro-acoustic driver. A coupling mechanism is at the first end of the body for receiving a sensing microphone and securing the microphone against the body at a predetermined fixed distance from the electro-acoustic driver.

29 Claims, 8 Drawing Sheets

(56) References Cited

U.S. PATENT DOCUMENTS

| | | | | |
|---|---|---|---|---|
| 7,466,838 | B1* | 12/2008 | Moseley | G10K 11/1788 381/370 |
| 8,107,665 | B2 | 1/2012 | Haapapuro et al. | |
| 8,682,001 | B2 | 3/2014 | Annunziato et al. | |
| 2007/0253568 | A1* | 11/2007 | Sapiejewski | H04R 1/1075 381/71.6 |
| 2009/0141924 | A1* | 6/2009 | Her | H04R 1/1075 381/380 |
| 2012/0155667 | A1* | 6/2012 | Nair | G10K 11/178 381/71.6 |
| 2013/0136279 | A1* | 5/2013 | Brown | H04R 1/105 381/151 |
| 2014/0205131 | A1 | 7/2014 | Azmi et al. | |
| 2015/0350762 | A1* | 12/2015 | Birger | H04R 1/1016 381/74 |
| 2016/0293156 | A1* | 10/2016 | Yang | G10K 11/1784 |

FOREIGN PATENT DOCUMENTS

| | | | |
|---|---|---|---|
| EP | 0688143 | A2 | 12/1995 |
| EP | 1850632 | A2 | 10/2007 |
| WO | 2007054807 | A2 | 5/2007 |

* cited by examiner

FEEDBACK MICROPHONE ADAPTOR FOR NOISE CANCELING HEADPHONE

BACKGROUND

This description relates generally to noise canceling headphones, and more specifically, to systems and methods for positioning a microphone at a predetermined distance from an electro-acoustic driver of an in-ear headphone.

BRIEF SUMMARY

In accordance with one aspect, provided is a microphone adaptor, comprising: a body having a first end, a second end, and an opening extending from the first end to the second end, the second end in communication with an electro-acoustic driver; and a coupling mechanism at the first end of the body for receiving a sensing microphone and securing the microphone against the body at a predetermined fixed distance from the electro-acoustic driver.

Aspects may include one or more of the following features:

The electro-acoustic driver may be part of an in-ear active noise reduction (ANR) headphone.

The body may be cylindrical.

The body may be integral with the electro-acoustic driver, and formed of a same material as the electro-acoustic driver.

The body may be removably coupled to the electro-acoustic driver.

The microphone adaptor may further comprise a snap-fit coupling at the second end of the body for mating with the electro-acoustic driver.

An acoustic opening of the sensing microphone may be perpendicular to, and offset to, a longitudinal direction of the electro-acoustic driver. A body of the sensing microphone may be positioned so as to not substantially impede sound radiated by the electro-acoustic driver through the opening of the body.

The sensing microphone may be aligned with a diaphragm of the electro-acoustic driver. A direction of movement of a diaphragm of the microphone may be perpendicular to an intended direction of movement of the diaphragm of the electro-acoustic driver.

A front face of the sensing microphone including an acoustic opening may be parallel with an intended direction of movement of the diaphragm of the electro-acoustic driver.

In accordance with one aspect, provided is a noise canceling headphone, comprising: a microphone adaptor having a first end, a second end, and an opening extending from the first end to the second end; a sensing microphone at the first end of the microphone adaptor for detecting an unwanted acoustic noise signal and converting the unwanted acoustic noise signal to a microphone electrical signal; and an electro-acoustic driver at the second end of the microphone adaptor for generating a canceling signal that attenuates the unwanted acoustic noise signal in response to the microphone electrical signal, wherein the adaptor is constructed and arranged for positioning the sensing microphone a predetermined fixed distance from the electro-acoustic driver.

Aspects may include one or more of the following features:

The noise canceling headphone may be an in-ear active noise reduction (ANR) headphone.

The electro-acoustic driver may comprise a basket; a diaphragm covering an opening in the basket; and a subassembly in the basket, wherein the adaptor is constructed and arranged to position the sensing microphone at a predetermined position and angle relative to at least one of the diaphragm or the subassembly.

The microphone adaptor may be snap-fit to the basket.

The sensing microphone may include a sensing surface. An angle of the sensing surface may be about 90 degrees relative to the diaphragm.

A face of the sensing microphone may include an acoustic opening for receiving the unwanted acoustic noise signal. The acoustic opening may extend in a direction that is substantially perpendicular to a direction of travel of acoustic radiator displacement of the diaphragm.

The acoustic opening of the sensing microphone may be proximal to the electro-acoustic driver. A body of the sensing microphone may be positioned so as to not substantially impede sound radiated by the electro-acoustic driver.

The subassembly may include a bobbin coupled to the diaphragm, a magnet, and a voice coil about the bobbin.

The sensing microphone may be positioned between the bobbin and the basket.

The sensing microphone may be positioned between the voice coil and the basket.

The sensing microphone may be positioned directly above the voice coil.

The diaphragm may include a central portion and an edge portion, wherein the central portion has a rigidity characteristic that is greater than that of the edge portion. The microphone may be positioned over the peripheral portion so that the central portion is directly exposed to a wearer's ear canal.

The microphone may be at a junction between the central portion and the edge portion of the diaphragm.

The microphone may be aligned with the edge portion of the diaphragm.

The microphone may be tangential to the junction between the central portion and the edge portion of the diaphragm.

The electro-acoustic driver may further comprise a surround between the diaphragm and the basket, and wherein the microphone is at a junction between the surround and the diaphragm.

The microphone may be tangential to the junction between the surround and the diaphragm.

The sensing microphone may be a MicroElectrical-Mechanical System (MEMS) microphone or a condenser microphone.

The microphone adaptor may include a coupling mechanism at the first end for receiving the sensing microphone and securing the microphone at a predetermined fixed distance from the electro-acoustic driver.

In another aspect, provided is a noise canceling headphone, comprising: a microphone adaptor having a first end, a second end, and an opening extending from the first end to the second end; a sensing microphone at the first end of the microphone adaptor for detecting an unwanted acoustic noise signal and converting the unwanted acoustic noise signal to a microphone electrical signal; and an electro-acoustic driver at the second end of the microphone adaptor for generating a canceling signal that attenuates the unwanted acoustic noise signal in response to the microphone electrical signal, wherein the sensing microphone is perpendicular to, and offset to, a longitudinal direction of the electro-acoustic driver, and positioned so as to not substantially impede sound radiated by the electro-acoustic driver through the opening of the microphone adaptor.

BRIEF DESCRIPTION

The above and further advantages of examples of the present inventive concepts may be better understood by referring to the following description in conjunction with the accompanying drawings, in which like numerals indicate like structural elements and features in various figures. The drawings are not necessarily to scale, emphasis instead being placed upon illustrating the principles of features and implementations.

DETAILED DESCRIPTION

Modern in-ear headphones, or earbuds, typically include a microspeaker, referred to as an electro-acoustic driver or transducer, attached to a diaphragm that pushes the air around it and creates a sound that is output to a user. In doing so, the microspeaker must produce a sufficient sound pressure over the entire frequency range over which the device will be used.

Certain headsets such as active noise reduction (ANR) headsets include a feedback microphone, also referred to as a sensing microphone, positioned near the driver over a front cavity of the headset. When the headset is placed in the ear of a wearer, the sensing microphone can detect ambient noise, and transmit to the driver a set of signals from which a set of driver electronics may produce an "anti-noise signal," or sound patterns out of phase with the ambient noise, which is used to attenuate the undesirable noise.

In conventional ANR headphones, the microphone is mounted to a wall or housing of the headphones. The location of the microphone has an impact on the driver output, and is important to how much cancellation occurs at the wearer's ear. For example, if the microphone is placed directly above the driver, then the body of the microphone may impede sound delivered from the driver to the ear drum. Furthermore, if the microphone acoustic inlet hole is facing a direction towards the driver, then the microphone cannot adequately sense the noise transmitted to the ear canal, again due to the blocking of sound by the body, therefore negatively impacting the noise cancelling performance. If the acoustic inlet hole is facing away from the driver, then it will take more time for the sound to travel from the driver to the microphone, thus reducing the bandwidth of a noise cancellation signal.

On the other hand, if the microphone is placed along the front cavity wall of the headset in configurations where the driver and the microphone are not directly coupled, then there may be more variation in the distance between the driver and the microphone from device to device due to manufacturing tolerances, which may result in more variation in the propagation delay for the signal to travel from the driver to the microphone. To ensure that the active system is stable on the device, the bandwidth needs to be reduced to accommodate more variation in the delay.

Positioning a microphone to the side of the driver (but not above the driver) may likewise result in an increase in time for the sound to travel from the driver to the microphone, thus reducing the bandwidth of noise cancellation.

Figure 1A:
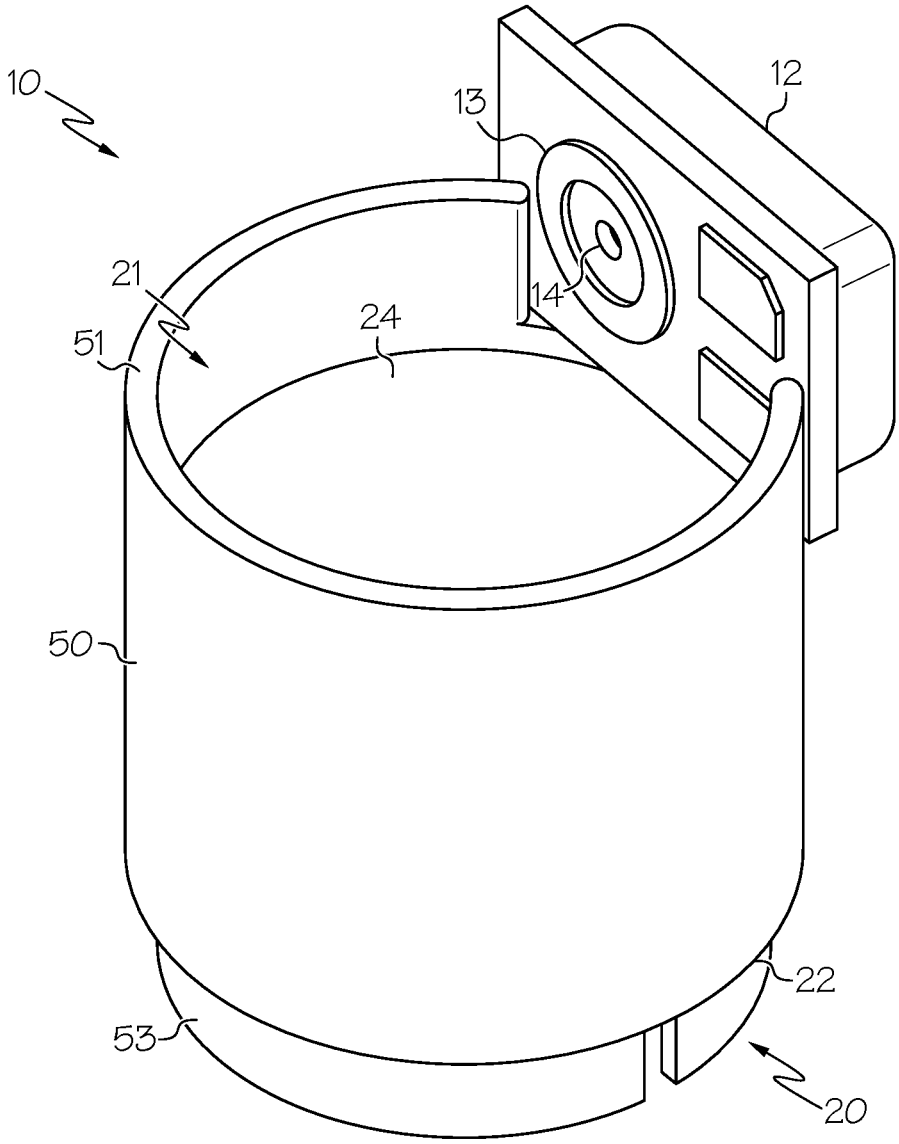
FIG. 1A is a perspective view of a microphone coupled to a microphone adaptor, in accordance with some examples.
Figure 1B:
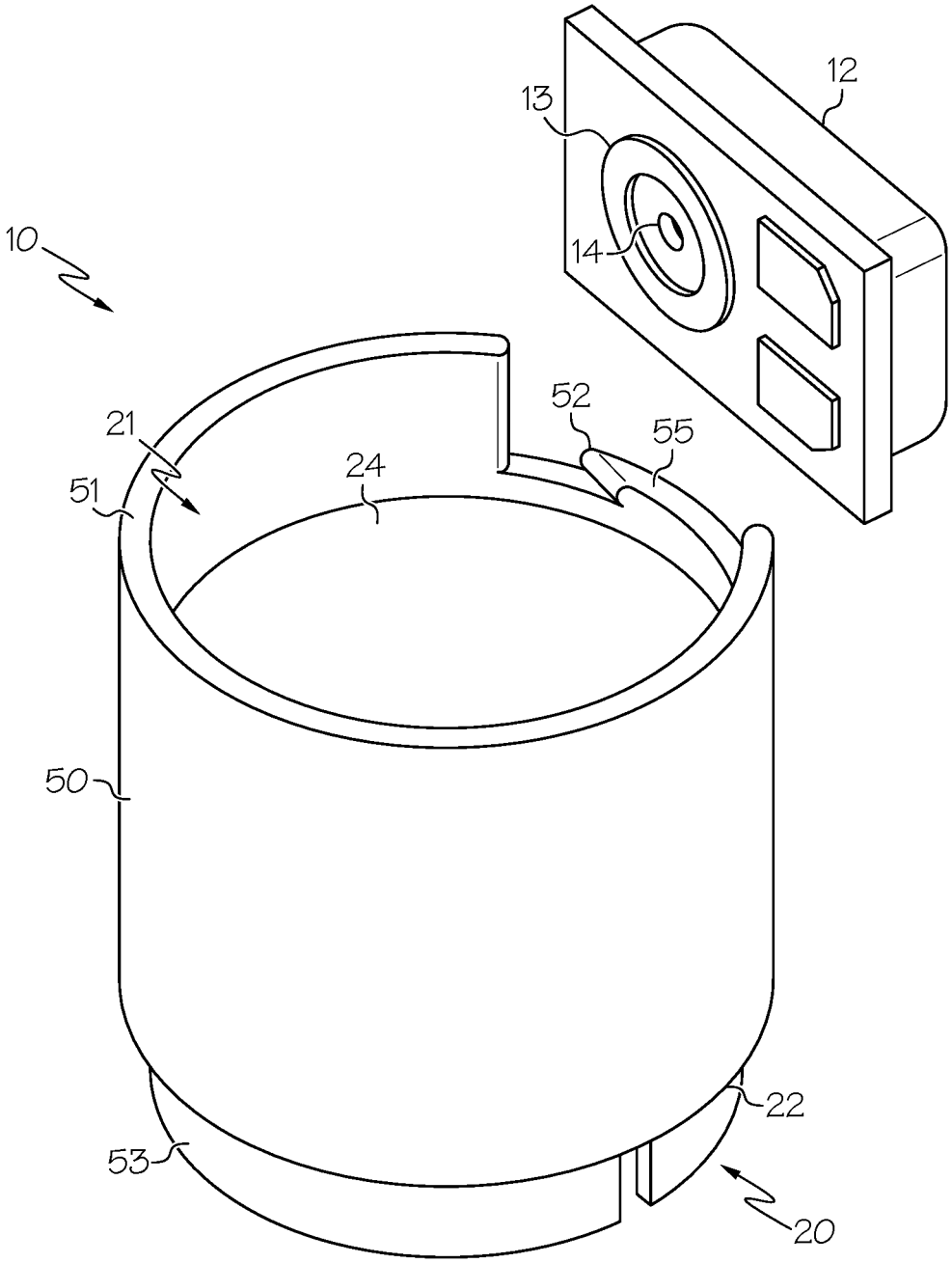
FIG. 1B is a perspective view of the microphone of FIG. 1A separate from the microphone adaptor.

Referring to FIGS. 1A and 1B, a microphone adaptor 10 is provided for positioning a microphone 12 or related sensor as close to an electro-acoustic driver 20 as possible. Although one driver configuration is shown, the microphone adaptor 10 is not limited for coupling with the driver 20 shown in FIGS. 1A and 1B; other driver assemblies may equally apply. The microphone 12 or related sensor can detect sound signals and produce a voltage or current proportional to the sound signal, but also does not impede the sound delivered from the driver to the ear drum during operation. This configuration also provides adequate cancellation at the ear opening, which is desirable for attenuating ambient noise by the in-ear headphone. The microphone adaptor 10 is constructed and arranged to precisely hold the microphone at a desired location and/or angle in reference to the driver, for example, shown in FIGS. 2A, 2B, and 3 while sensing and transducing, or "hearing" sound. More specifically, acoustic pressure may be detected and transduced in an adaptor front cavity 21 between an opening to a body 50 of the adapter 10 and a diaphragm 24 of the driver in the body 50. The front cavity 21 may be formed from a portion of the adaptor opening at or near a first end 51 of the body 50 when the driver is inserted into the second end 53 through another portion the opening at the second end 53. The adaptor 10 eliminates the need for anchoring the microphone 12 on the front cavity wall.

In some examples, the driver 20 is an electroacoustic transducer in an ANR headset. To achieve this, the microphone adaptor 10 may be formed of stainless steel or other materials that provide rigidity and structure to the adaptor 10 and permit the adaptor 10 to provide protection to driver elements such as diaphragm 24, and/or a dome, surround, and so on. In some examples, the microphone adaptor 10 is formed of same or similar materials as a transducer sleeve 22 to which the adaptor 10 is coupled or integral with.

The adapter body 50 may be cylindrical as shown, but is not limited thereto. The body 50 of the adaptor 10 includes the first end 51 at which a sensing microphone 12 is coupled, and the second end 53 at which an electro-acoustic driver is coupled. The microphone adaptor 10 also has an opening that extends from the first end 51 to the second end 53. The adaptor 10 is therefore constructed and arranged for coupling at the second end 53 to the electro-acoustic driver. In doing so, the sensing microphone 12 is positioned at a predetermined fixed distance and orientation from the electro-acoustic driver, in particular, driver elements such as the diaphragm 24, and/or voice coil, surround, bobbin, sleeve (also referred to as a housing, enclosure, or basket), or a combination thereof.

Figure 2A:
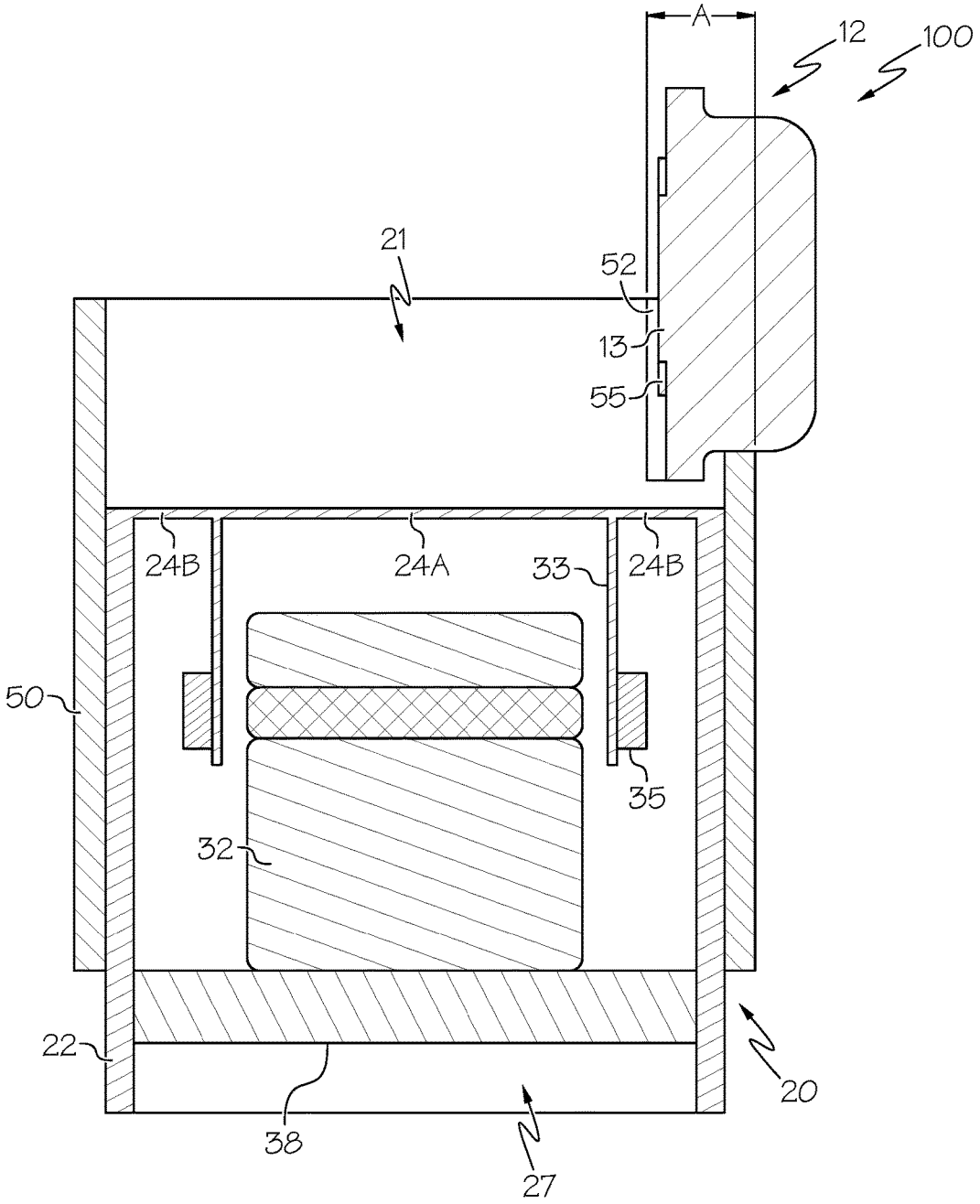
FIG. 2A is a cross-sectional front view of a noise canceling headphone, in accordance with some examples.

The first end 51 includes an interface cavity 52, or notch, opening or the like in which the microphone 12 or related ANR sensor may be removably positioned. The interface cavity 52 (different than front cavity 21) may include a coupling mechanism 55 for securely positioning the microphone 12 in the interface cavity 52 of the adaptor 10. As shown in FIG. 2A, a surface of a microphone sensing surface, for example, a front face 13 of the microphone 12, may be positioned against the coupling mechanism 55. The microphone 12 may be attached to the coupling mechanism 55 by adhesive or other bonding technique.

Figure 4:
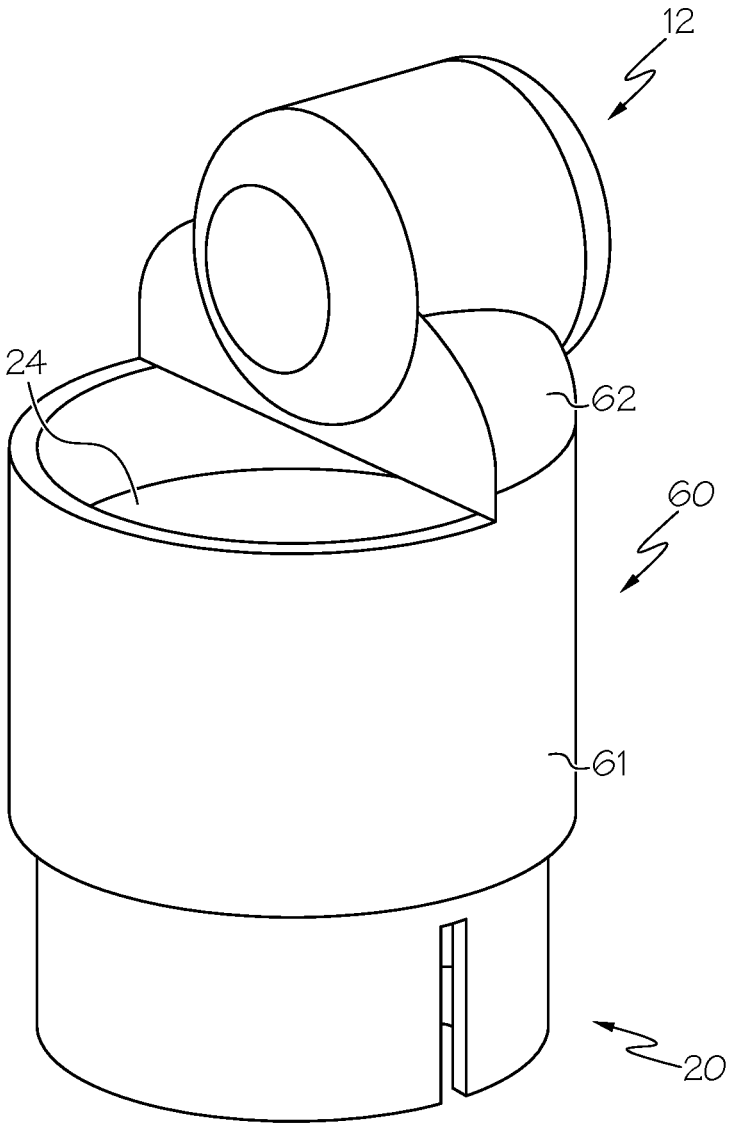
FIG. 4 is a perspective view of a condenser microphone coupled to a microphone adaptor, in accordance with some examples.

In some examples, as shown in FIG. 4, a microphone adaptor 60 can include a base portion 61 and a top portion 62 for receiving and positioning a condenser microphone 12 or the like. Here, the top portion 62 may cover a portion of the diaphragm 24 and permits the microphone 12 to be positioned above an exposed portion of the diaphragm 24. The size and shape of the microphone 12 may establish spatial constraints on orientation of the microphone 12 relative to the adaptor 60. Accordingly, the microphone 12 may preferably be positioned over the stiffest region of an acoustic radiating surface of the diaphragm 24 directly above the voice coil 35 to a radiator attachment. For example, as shown in FIG. 2A, a region (R) is where a force generated by the voice coil 35 is transferred to the acoustic radiating surface 24A by the voice coil bobbin 33. The radiator attachment here is the interface (R) between the voice coil/bobbin assembly and the acoustic radiating surface 24A. This region (R) will always be the most rigid of the radiator surface due to the structural reinforcement of the bobbin 33. An acoustic inlet hole 14, or acoustic opening, in the front face 13 of the microphone 12 is directly above the voice coil (shown in FIGS. 2A and 2B).

Figure 2B:
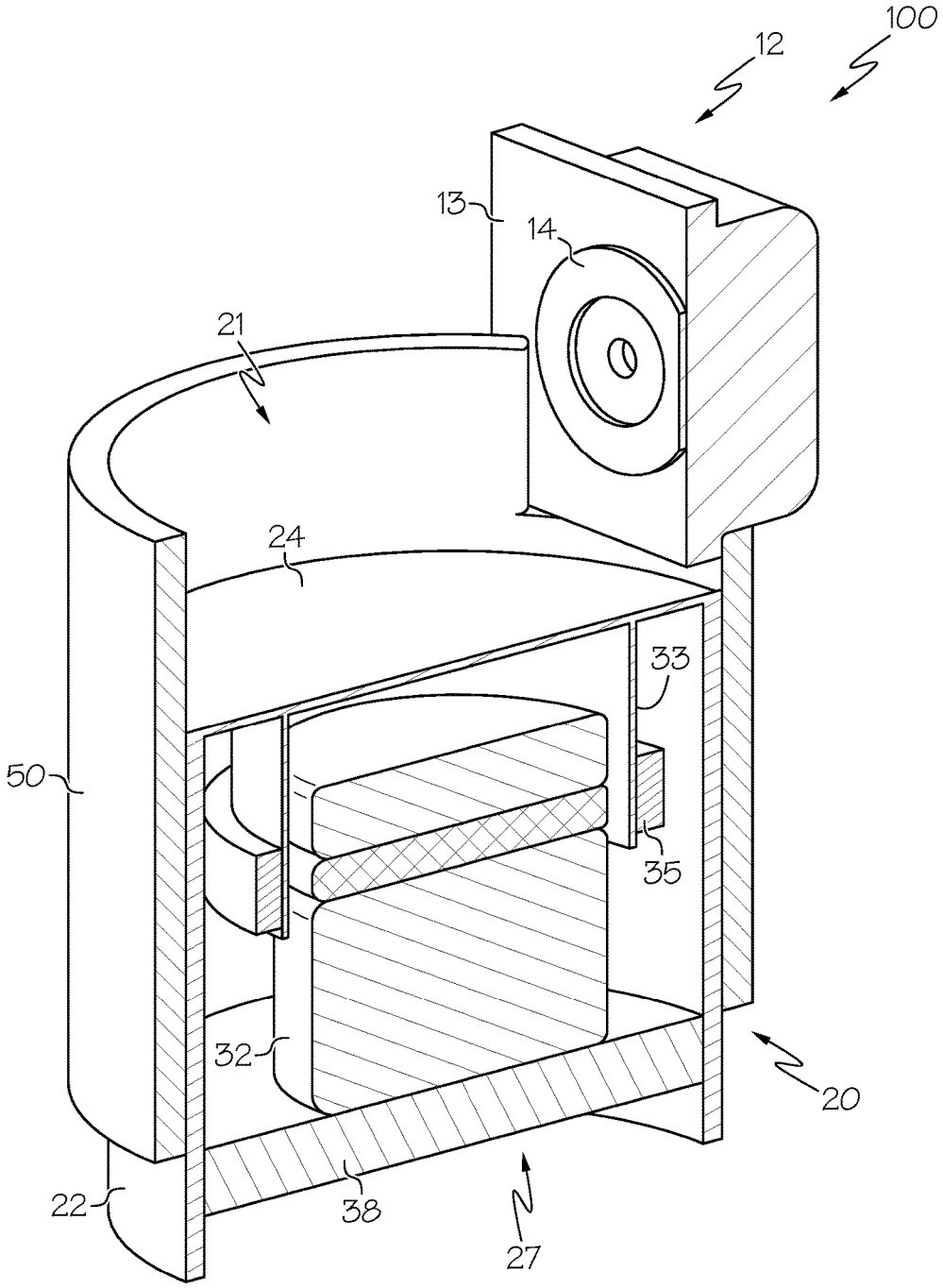
FIG. 2B is a cross-sectional perspective view of the noise canceling headphone of FIG. 2A.
Figure 5A:
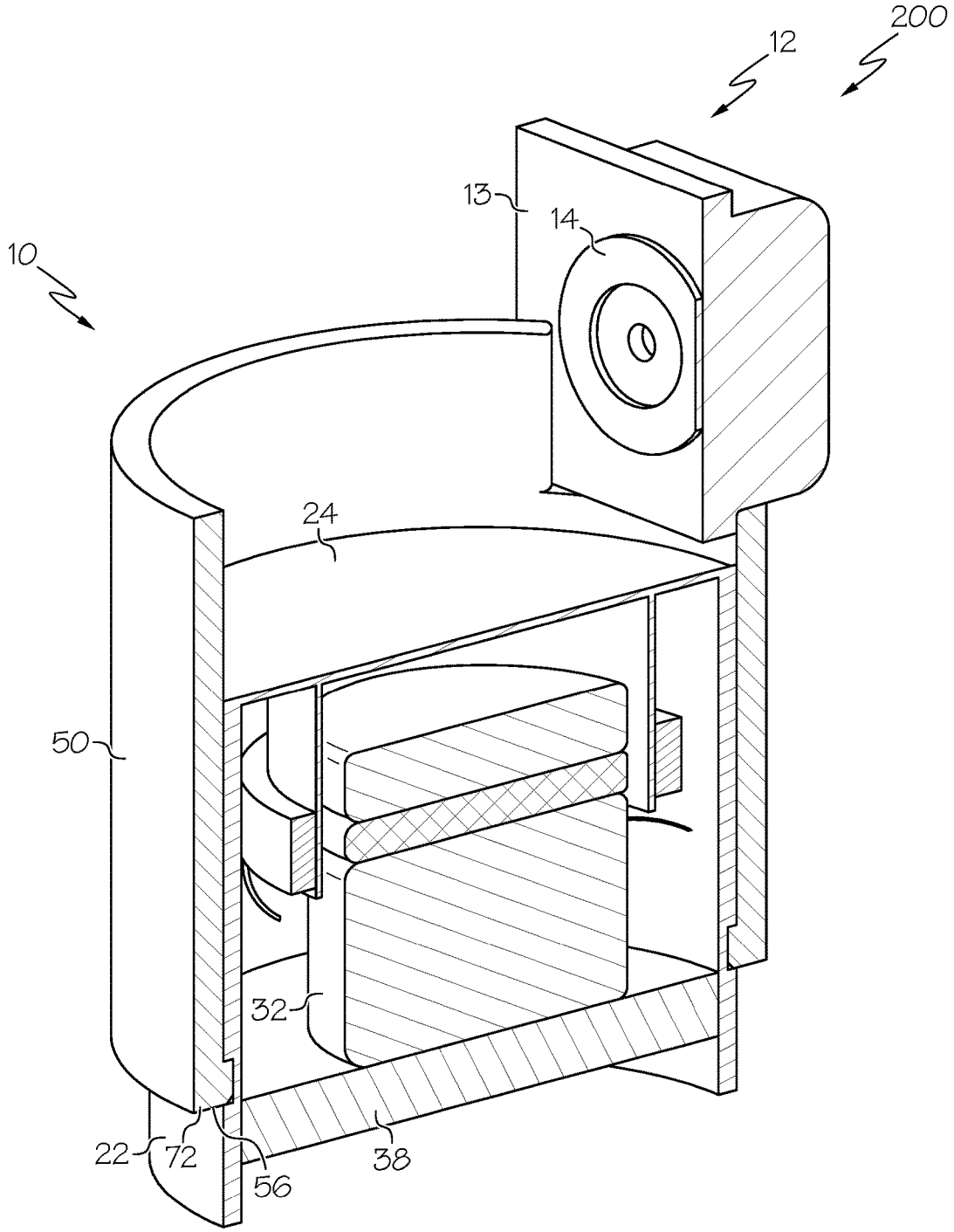
FIGS. 5A and 5B are perspective and top views of a microphone coupled to a microphone adaptor, in accordance with other examples.
Figure 5B:
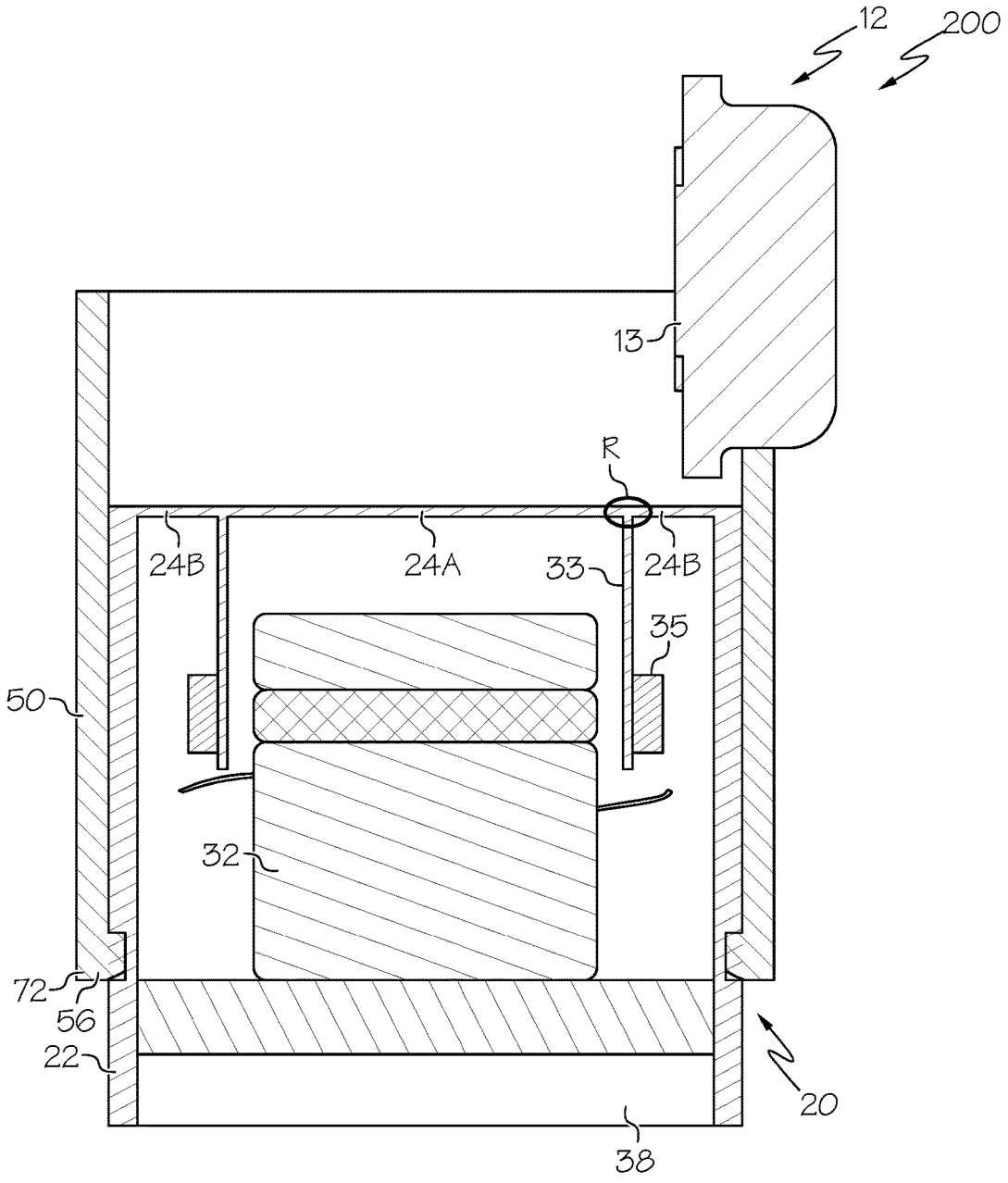

The second end 53 of the microphone adaptor 10 may mate with the driver sleeve 22. For example, as shown in the headphone 200 of FIGS. 5A and 5B, the microphone adapter 10 may include a protruding edge 72, lip, or related snap-fit coupling that mates, or snap-fits, with a groove or notch 56 in the driver sleeve 22. In other examples, as shown in FIGS. 2A and 2B, the second end 53 is constructed and arranged for bonding, or otherwise coupling to a sleeve, housing, basket, or other enclosure of an electro-acoustic transducer.

Figure 3:
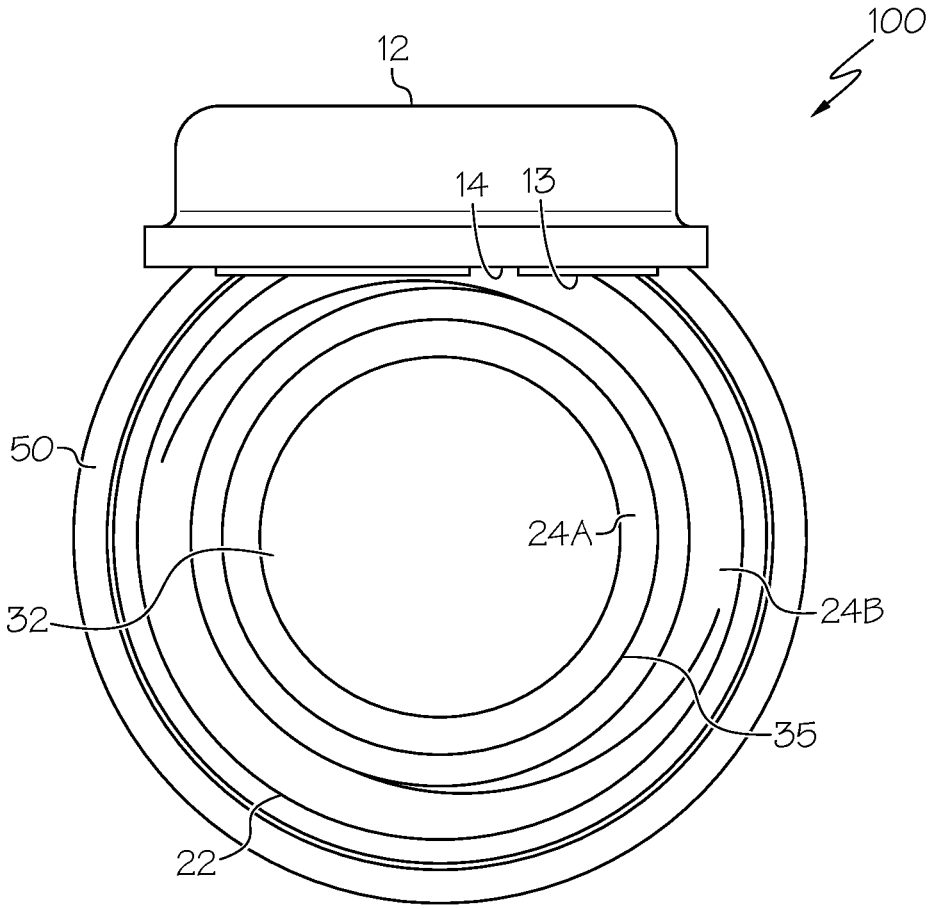
FIG. 3 is a cross-sectional top view of a noise canceling headphone, illustrating an orientation of a microphone relative to an electro-acoustic driver, in accordance with some examples.

In some examples, the microphone 12 when positioned in the adaptor cavity 52 is oriented at 90 degrees, or tangential, to the surface of the first end 51 of the adaptor 10. The microphone 12 is oriented in this manner to minimize impedance or otherwise optimize ANR performance with respect to an acoustic path between a user's ear canal and the electro-acoustic driver to which the microphone adaptor 10 is coupled. More specifically, as shown in FIG. 2A, the microphone acoustic inlet hole 14 is aligned substantially along a same plane or axis as the voice coil of the driver 20. Or as shown in FIG. 3, the microphone acoustic inlet hole 14 is positioned along a same circle as the voice coil. The microphone inlet hole 14 may have a minimal offset distance, i.e., offset with respect to the voice coil to minimize delay, and thus optimizing device performance.

In some examples, the microphone adaptor 10 functions as a speaker driver basket, which is coupled to an end of the driver sleeve 22, and protects the diaphragm 24, dome, surround, and/or related elements from damage, due to the rigidity and solid construction of the adaptor 10, e.g., formed of stainless steel or similar materials, and its alignment with these essential driver elements.

In other examples, the microphone adaptor 10 includes a basket that is integral with the driver sleeve, for example, extending from or being part of an end of the driver sleeve.

As shown in FIGS. 2A and 2B, a noise canceling in-ear headphone 100 may include a microphone adaptor 10 coupled to an electro-acoustic transducer 20, and a microphone 12 held in place in the microphone adaptor 10. The electro-acoustic transducer 20 may include but not be limited to a sleeve 22, a diaphragm 24 covering an end of the sleeve 22, an acoustic subassembly 30, and a back plate 38. The subassembly 30 may include but not be limited to a bobbin 33 coupled to the diaphragm 24, a magnet 32, and a voice coil 35 about the bobbin 33. The magnet 32 is positioned between the front plate diaphragm 24, voice coil 35, bobbin 33 and back plate 38. A printed circuit board (PCB) (not shown) may be positioned at an end of the sleeve 22 opposite the end at which the diaphragm 24 is positioned. The PCB may include audio processing electronics that receive and process a microphone signal generated by the microphone 12 in response to sensing ambient noise, for example, and provide canceling sound waves that can be combined or mixed with existing ambient noise for output by the transducer 20 to reduce an overall noise level. In doing so, the PCB may provide an ANR closed-loop control circuit between the microphone 12 and the transducer 20 to cancel or otherwise attenuate undesirable noise so that the transducer 20 outputs an improved sound to the wearer's ear. The PCB may be separated from the back plate 38 by a predetermined distance so that a cavity 27 is formed between the PCB, the back plate 38, and an outermost end of the sleeve 22.

The diaphragm 24 may be in the shape of a cone, dome, planar sheet (as shown), or other shape. The diaphragm 24 may be attached to the bobbin 33. The diaphragm may be formed of silicone, polymer, or other flexible pliable material. In some examples, the diaphragm 24 extends along an opening to the sleeve 22 and is attached to the sleeve 22 as shown. In other examples, a surround or the like is positioned about the perimeter of the sleeve 22 so that the surround or the like is between the diaphragm 24 and the sleeve 22.

The microphone 12 is constructed and arranged to detect an acoustic noise signal in a front cavity 21 of the adaptor 10, for example, an undesirable ambient sound entering the cavity 21 from an external environment. When the adaptor 10 is coupled to the transducer 20, the adaptor 10 can extend the length or other dimension of the cavity of the transducer 20 about the diaphragm 24, for example, permitting the microphone 12 to be positioned closer to the wearer's ear canal than the transducer 20 without the adaptor 10. The microphone 12 converts the received acoustic noise signal into a microphone signal for use in active noise reduction, noise canceling, noise suppression, or the like. In some examples, the microphone 12 is a condenser microphone (see FIG. 4) or related microphone, for example, a subminiature electret condenser microphone or the like, but is not limited thereto. In other examples, the microphone 12 can be a microelectromechanical (MEMS) microphone, or any microphone that is sensitive to ambient noise.

As described herein, the microphone adaptor 10 is constructed to position the microphone 12 at a predetermined position and angle relative to an electro-acoustic transducer diaphragm 24A, 24B (generally, 24). The microphone adaptor 10 is positioned at a front cavity 21 formed between the diaphragm 24 of the transducer 20 and a wearer for picking up a frequency and amplitude profile at an instant in time, and to minimize phase lag, which may occur due to propagation delay, and which can be achieved by optimizing the distance between the microphone and the electro-acoustic transducer 20.

In some examples, the microphone 12 when positioned in the adaptor cavity 52 is oriented at 90 degrees, or tangential, to the surface of the first end 51 of the adaptor 10. In other examples, the front face 13 of the microphone 12, or opening in the microphone 12 is aligned with a diaphragm in the microphone 12 that is sensitive to sound pressure received via the microphone opening. Thus, the direction of movement of the microphone diaphragm is substantially perpendicular to the direction of movement of the driver diaphragm 24 covering the end of the sleeve 22. In a related example, the front face of configurations of the microphone 12 is parallel to the intended direction of movement of the driver diaphragm 24. The microphone 12 is oriented in this manner to minimize impedance or otherwise optimize ANR performance with respect to an acoustic path between a user's ear canal and the electro-acoustic driver to which the microphone adaptor 10 is coupled.

As shown in FIGS. 2A and 2B the microphone 12 is positioned in the adaptor 10 to be closer to the wearer's ear canal than the diaphragm 24, for example, positioned in a portion of the cylindrical wall of the adaptor 10 so that the adaptor front cavity 21 is uninterrupted by the microphone 12.

In some examples, the diaphragm 24 includes a central portion 24A and a peripheral or edge portions 24B. A peripheral portion 24B of the diaphragm may extend from the bobbin 33. The central diaphragm portion 24A may have a stiffness or related rigidity characteristic that is greater than that of the edge portion 24B. A treatment may be applied to form regions of the diaphragm having different stiffnesses or related features. In other examples, a peripheral portion 24B may instead be a surround or the like may be positioned between the diaphragm 24A and the sleeve 22. Here, the surround 24A and the diaphragm 24B may be formed of different materials, or of same or similar materials having different rigidities, elasticities, or related characteristics.

In some examples where the magnet 32 is positioned inside the voice coil 35, as shown in FIG. 2B, the outside diameter of the sleeve 22 is less than about 8 mm. In some examples, the sleeve 22 has an outside diameter that is less than about 4.5 mm. In other examples, the sleeve 22 has an outside diameter that is between about 3.0 mm and 4.5 mm. In other examples, the sleeve 22 has an outside diameter that is between about 3.3 mm and 4.2 mm. In other examples, the sleeve 22 has an outside diameter that is between about 3.6 mm and 3.9 mm. In some examples, the magnet 32 has a diameter that is between about 1.5 mm and 4.5 mm. In other examples, the magnet 32 has a diameter that is between about 2.0 mm and 4.0 mm. In other examples, the magnet 32 has a diameter that is between about 2.5 mm and 3.5 mm. In some examples, a ratio of the radiating area to total cross sectional area of the driver is about 0.7. In some examples, a ratio of the radiating area to total cross sectional area of the driver is between 0.57-0.7. In some examples, a ratio of the radiating area to total cross sectional area of the driver is between 0.6-0.67. In some examples, a ratio of the radiating area to total cross sectional area of the driver is between 0.62-0.65.

The interface cavity 52 of the microphone adaptor 10 is offset by a distance (A) from the wall of the adaptor 10 so as to be positioned between over the diaphragm edge portion 24B between the bobbin 33 and the sleeve 22 when the adaptor 10 is positioned over the sleeve 22. Accordingly, the microphone 12 may be positioned over the diaphragm edge portion 24B between the bobbin 33 and the sleeve 22. The diaphragm central portion 24A may therefore be directly exposed to the wearer's ear canal when the headphone 100 is positioned in the wearer's ear.

In some examples, the adaptor 10 is constructed and arranged for the microphone 12 to be at an interface or junction between edge portion 24B and central portion 24A of the diaphragm. In other examples where the transducer 20 includes a surround, the microphone 12 may be at an interface or junction between the surround and diaphragm 24. In other examples, the microphone 12 is positioned between the bobbin 33 and/or voice coil 35 and the sleeve 22, for example, aligned with the edge portion 24B of the diaphragm. In other examples, the face 13 of the microphone 12 having a microphone opening is aligned in a longitudinal direction of the sleeve 22, for example, tangential to the bobbin 33, the voice coil 35 or the diaphragm edge portion 24B. Also, from a top view, the microphone 12 may be positioned to be tangential to the voice coil 35 so that the microphone opening is facing an interior region surrounded by the voice coil 35 and that exposes the diaphragm 24, for example, at least the central portion 24A, so that the microphone body does not block the driver and the ambient noise signal and it can receive the driver signal with minimum phase lag and at the same time adequately sense the ambient noise transmitted to the ear canal.

In some examples, the feedback microphone 12 may be integral with the driver assembly 20, for example, a basket or the like of the driver assembly 20, to eliminate the need for anchoring the microphone on the front cavity wall, and provide for the presence of a front cavity without hard walls. Here, the microphone 12 and driver assembly 20 can be surrounded by tips or the like.

A number of implementations have been described. Nevertheless, it will be understood that the foregoing description is intended to illustrate and not to limit the scope of the inventive concepts which are defined by the scope of the claims. Other examples are within the scope of the following claims.

What is claimed is:

1. A microphone adaptor, comprising:

a body having a first end, a second end, a cavity wall extending in a linear direction of extension between the first end and the second end, and an opening surrounded by the cavity wall and extending in the linear direction of extension from the first end to the second end, a portion of the cavity wall at the second end in communication with a sidewall of an electro-acoustic driver; and a coupling mechanism at the first end of the body for receiving a sensing microphone and securing the microphone against the body so that the microphone extends from the cavity wall at a predetermined fixed distance from the electro-acoustic driver and so that at least a portion of an acoustic opening of the sensing microphone is directed at the opening of the body and extends above and over a rigid peripheral region of a diaphragm that is above a voice coil and extends between the voice coil and the sidewall of the electro-acoustic driver for sensing sound radiated by the electro-acoustic driver through the opening of the body.

2. The microphone adaptor of claim 1, wherein the electro-acoustic driver is part of an in-ear active noise reduction (ANR) headphone.

3. The microphone adaptor of claim 1, wherein the body is cylindrical.

4. The microphone adaptor of claim 1, wherein the body is integral with the electro-acoustic driver, and is formed of a same material as the electro-acoustic driver.

5. The microphone adaptor of claim 1, wherein the body is removably coupled to the electro-acoustic driver.

6. The microphone adaptor of claim 5, further comprising a snap-fit coupling at the second end of the body for mating with the electro-acoustic driver.

7. The microphone adaptor of claim 1, wherein the acoustic opening of the sensing microphone is perpendicular to, and offset to, a longitudinal direction of the electro-acoustic driver, and wherein a body of the sensing microphone is positioned so as to not substantially impede the sound radiated by the electro-acoustic driver through the opening of the body.

8. The microphone adaptor of claim 1, wherein the sensing microphone is aligned with a diaphragm of the electro-acoustic driver, and wherein a direction of movement of a diaphragm of the microphone is perpendicular to an intended direction of movement of the diaphragm of the electro-acoustic driver.

9. The microphone adaptor of claim 8, wherein a front face of the sensing microphone including the acoustic opening is parallel with an intended direction of movement of the diaphragm of the electro-acoustic driver.

10. A noise canceling headphone, comprising:

a microphone adaptor having a first end, a second end, a cavity wall extending in a linear direction of extension between the first end and the second end, and an opening surrounded by the cavity wall and extending in the linear direction of extension from the first end to the second end;

a sensing microphone removably coupled to the first end of the microphone adaptor and extending from the cavity wall for detecting an unwanted acoustic noise signal and converting the unwanted acoustic noise signal to a microphone electrical signal; and an electro-acoustic driver in communication with a portion of the cavity wall at the second end of the microphone adaptor for generating a canceling signal that attenuates the unwanted acoustic noise signal in response to the microphone electrical signal, wherein the adaptor is constructed and arranged for positioning the sensing microphone a predetermined fixed distance from the electro-acoustic driver so that at least a portion of an acoustic opening of the sensing microphone is directed at the opening of the body and extends above and over a rigid peripheral region of a diaphragm that is above a voice coil and extends between the voice coil and a sidewall of the electro-acoustic driver for sensing sound radiated by the electro-acoustic driver through the opening of the microphone adaptor.

11. The noise canceling headphone of claim 10, wherein the noise canceling headphone is an in-ear active noise reduction (ANR) headphone.

12. The noise canceling headphone of claim 10, wherein the electro-acoustic driver comprises:

a basket;

a diaphragm covering an opening in the basket; and a subassembly in the basket, wherein the adaptor is constructed and arranged to position the sensing microphone at a predetermined position and angle relative to at least one of the diaphragm or the subassembly.

13. The noise canceling headphone of claim 12, wherein the microphone adaptor is snap-fit to the basket.

14. The noise canceling headphone of claim 12, wherein the sensing microphone includes a sensing surface, and wherein the angle of the sensing surface is about 90 degrees relative to the diaphragm.

15. The noise canceling headphone of claim 12, wherein a face of the sensing microphone includes the acoustic opening for receiving the unwanted acoustic noise signal, and wherein the acoustic opening extends in a direction that is substantially perpendicular to a direction of travel of acoustic radiator displacement of the diaphragm.

16. The noise canceling headphone of claim 15, wherein the acoustic opening of the sensing microphone is proximal to the electro-acoustic driver, and a body of the sensing microphone is positioned so as to not substantially impede sound radiated by the electro-acoustic driver.

17. The noise canceling headphone of claim 12, wherein the subassembly includes a bobbin coupled to the diaphragm, a magnet, and a voice coil about the bobbin.

18. The noise canceling headphone of claim 17, wherein the sensing microphone is positioned between the bobbin and the basket.

19. The noise canceling headphone of claim 17, wherein the sensing microphone is positioned between the voice coil and the basket.

20. The noise canceling headphone of claim 17, wherein the sensing microphone is positioned directly above the voice coil.

21. The noise canceling headphone of claim 12, wherein the diaphragm includes a central portion and an edge portion including the rigid peripheral region, wherein the central portion has a rigidity characteristic that is greater than that of the edge portion, and wherein the microphone is positioned over the peripheral portion region so that the central portion is directly exposed to a wearer's ear canal.

22. The noise canceling headphone of claim 21, wherein the microphone is at a junction between the central portion and the edge portion of the diaphragm.

23. The noise canceling headphone of claim 22, wherein the microphone is aligned with the edge portion of the diaphragm.

24. The noise canceling headphone of claim 23, wherein the microphone is tangential to the junction between the central portion and the edge portion of the diaphragm.

25. The noise canceling headphone of claim 12, wherein the electro-acoustic driver further comprises a surround between the diaphragm and the basket, and wherein the microphone is at a junction between the surround and the diaphragm.

26. The noise canceling headphone of claim 25, wherein the microphone is tangential to the junction between the surround and the diaphragm.

27. The noise canceling headphone of claim 10, wherein the sensing microphone is a MicroElectrical-Mechanical System (MEMS) microphone or a condenser microphone.

28. The noise canceling headphone of claim 10, wherein the microphone adaptor includes a coupling mechanism at the first end for receiving the sensing microphone and securing the microphone at a predetermined fixed distance from the electro-acoustic driver.

29. A noise canceling headphone, comprising:

a microphone adaptor having a first end, a second end, a cavity wall extending in a linear direction of extension between the first end and the second end, and an opening surrounded by the cavity wall and extending in the linear direction of extension from the first end to the second end;

a sensing microphone removably coupled to the first end of the microphone adaptor and extending from the cavity wall for detecting an unwanted acoustic noise signal and converting the unwanted acoustic noise signal to a microphone electrical signal; and an electro-acoustic driver in communication with a portion of the cavity wall at the second end of the microphone adaptor for generating a canceling signal that attenuates the unwanted acoustic noise signal in response to the microphone electrical signal, wherein the sensing microphone is perpendicular to, and offset to, a longitudinal direction of the electro-acoustic driver, and positioned so as to not substantially impede sound radiated by the electro-acoustic driver through the opening of the microphone adaptor and so that at least a portion of an acoustic opening of the sensing microphone is directed at the opening of the body and extends above and over a rigid peripheral region of a diaphragm that is above a voice coil and extends between the voice coil and a sidewall of the electro-acoustic driver for sensing sound radiated by the electro-acoustic driver through the opening of the microphone.

* * * * *